United States Patent [19]

Stringham

[11] Patent Number: 4,848,842

[45] Date of Patent: Jul. 18, 1989

[54] ADJUSTABLE BENCH

[76] Inventor: Edward E. Stringham, 10204 Transit Rd., East Bethany, N.Y. 14054

[21] Appl. No.: 232,791

[22] Filed: Aug. 16, 1988

Related U.S. Application Data

[63] Continuation-in-part of Ser. No. 153,769, Feb. 8, 1988, which is a continuation-in-part of Ser. No. 936,154, Dec. 1, 1986, abandoned.

[51] Int. Cl.[4] ..... A47C 7/50

[52] U.S. Cl. ..... 297/431; 297/345; 297/435

[58] Field of Search ..... 297/430, 431, 434, 435, 297/436, 439, 345, 424

[56] References Cited

U.S. PATENT DOCUMENTS

| | | | |
|---|---|---|---|
| 663,632 | 12/1900 | Mack | 297/424 |
| 815,046 | 3/1906 | Sherman | 297/439 X |
| 2,150,844 | 3/1939 | Raders | 297/431 |
| 4,410,215 | 10/1983 | McKean et al. | 297/431 |

*Primary Examiner*—Francis K. Zugel
*Attorney, Agent, or Firm*—Howard Greenwald

[57] ABSTRACT

A portable, quick-release, height-adjustable bench is disclosed. This bench is comprised of a platform, a height-adjustable seat operatively connected to said platform, means for adjusting the height of said height-adjustable seat, a height-adjustable footrest slidably engageable with said platform, means for adjusting the height of said footrest, and means for maintaining said height-adjustable seat and said height-adjustable footrest in positions such that they are always substantially parallel to each other.

3 Claims, 5 Drawing Sheets

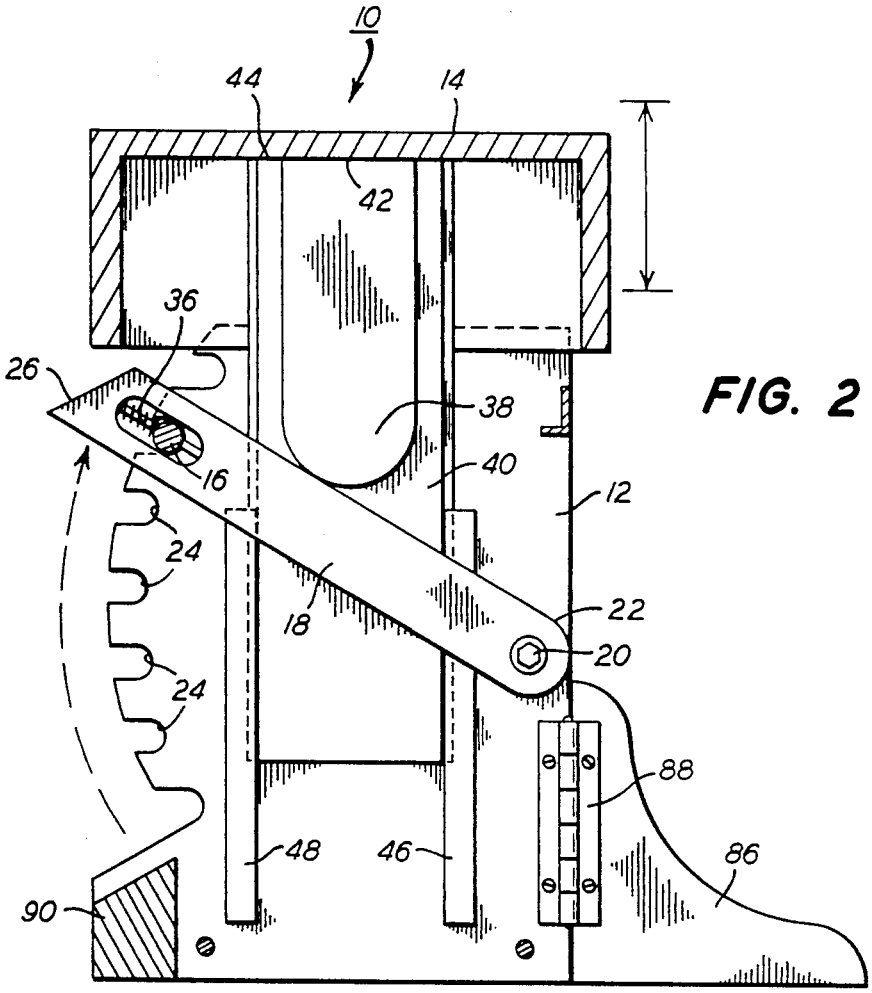
FIG. 2
FIG. 3A
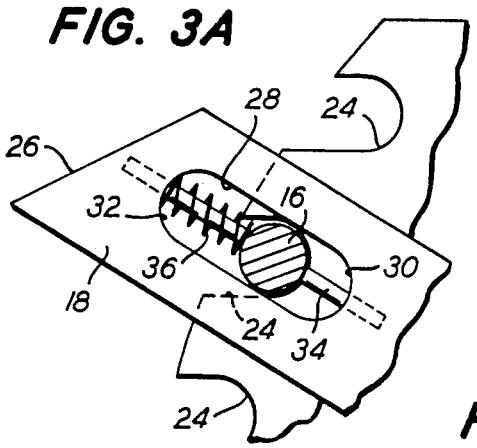
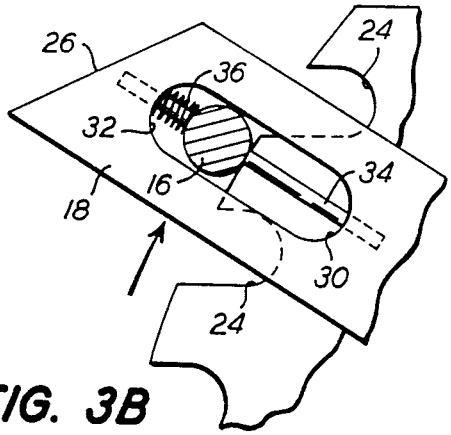
FIG. 3B

ADJUSTABLE BENCH

FIELD OF THE INVENTION

A portable, quick-release, height-adjustable bench especially useful as a piano bench.

CROSS-REFERENCE TO RELATED APPLICATIONS

This application is a continuation-in-part of applicant's copending application Ser. No. 153,769 filed on Feb. 8, 1988 which, in turn, was a continuation-in-part of applicant's copending application U.S. Ser. No. 936,154, filed on Dec. 1, 1986, now abandoned.

BACKGROUND OF THE INVENTION

Adjustable benches have been described in the prior art. However, many of the prior art benches are not especially suitable for use as adjustable piano benches.

It is an object of this invention to provide a novel adjustable bench which has a combination of features that, to the best of applicant's knowledge, is not possessed by any of the adjustable benches of the prior art. Thus, it is an object of this invention to provide an adjustable bench which contains both an adjustable seating or bench platform and an adjustable footrest, both of which can be adjusted separately. It is a further object of this invention to provide an adjustable bench with a footrest which is slidably engagable with the body of the bench. It is a further object of this invention to provide an adjustable bench wherein, regardless of the adjustment(s) made to the platform and/or the footrest, the platform and footrest always remain substantially parallel to each other.

SUMMARY OF THE INVENTION

In accordance with this invention, there is provided a portable, quick-release, height-adjustable bench comprised of a platform, a height-adjustable seat operatively connected to said platform, means for adjusting the height of said height-adjustable seat, a height-adjustable footrest slidably engagable with said platform, means for adjusting the height of said footrest, and means for maintaining said height-adjustable seat and said height-adjustable footrest in positions such that they are always substantially parallel to each other.

DESCRIPTION OF THE DRAWINGS

The present invention will be more fully understood by reference to the following detailed description theroef, when read in conjunction with the attached drawings, wherein like reference numerals refer to like elements wherein:

FIG. 2 is a sectional view of the bench of FIG. 1 showing the platform of said bench in the up position;

FIGS. 3A and 3B are partial sectional views of a springloaded rod used in the bench of FIG. 1;

DESCRIPTION OF THE PREFERRED EMBODIMENTS

Figure 1:
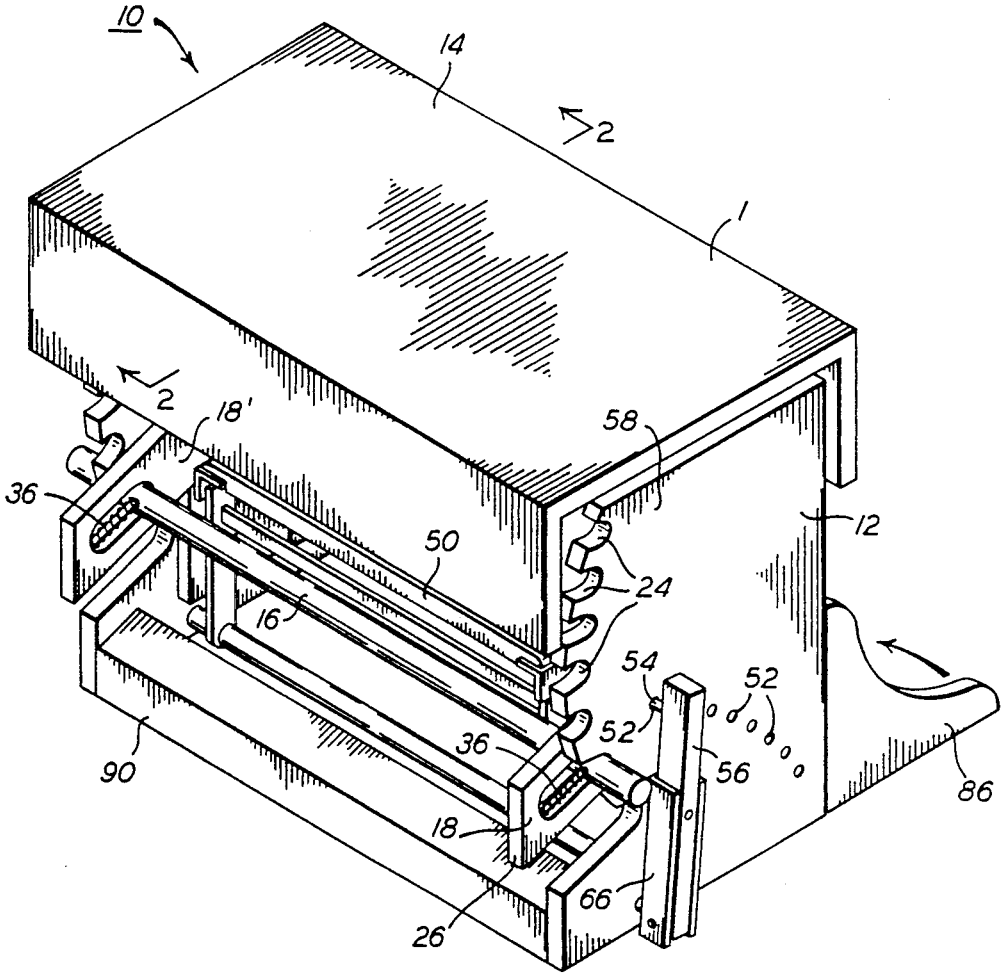
FIG. 1 is a perspective view of one of the preferred height-adjustable benches of this invention.

One of the preferred embodiments of applicant's invention is illustrated in FIG. 1. Referring to FIG. 1, portable, quick-release, height-adjustable bench 10 is comprised of platform 12, height adjustable seat 14 operatively connected to said platform 12, and means for adjusting the height of seat 14 comprised of rod 16 and levers 18 and 18'.

In the apparatus of this invention, regardless of which respective heights the seat and the footrest are at, the seat and footrest are always substantially parallel to each other. The term substantially parallel, as used in this specification, means that, with regard to a fixed reference surface (such as, for example, the floor on which the bench sits), the seat and footrest will both form angles which are within about ten percent of each other. Thus, for example, with regard to the floor on which the height adjustable bench is placed, the seat and footrest will both form an angle of from about 170 to about 190 degrees and, preferably, from about 175 to about 185 degrees. Furthermore, the angle formed by the seat with the floor, e.g., will be from about 0.9 to about 1.1 times the angle formed by the footrest with the floor. In a more preferred embodiment, the angle formed by the seat with the reference surface (such as the floor) will be from about 0.95 to about 1.05 times the angle formed by the footrest with said surface. In the most preferred embodiment, the angle formed by the seat with the reference surface will be from about 0.98 to about 1.02 times the angle formed by the footrest with the reference surface.

Thus, both the seat and footrest are provided with means for incrementally adjusting each of their heights and maintaining each of their surfaces so that they are always substantially parallel to each other. The preferred adjustment and maintenance means are discussed in detail below.

In the embodiment illustrated in the Figures, two levers 18 are utilized to raise and lower seat 14. Each of levers 18 and 18' is rotatably attached to platform 12 so that it can be moved from the down position illustrated in FIG. 1 towards and/or up to the up position illustrated in FIGS. 2, 4, and 5. Any means for rotatably securing lever 18 to platform 12 known to those skilled in the art may be utilized. Thus, e.g., one may place a bolt 20 through proximal end portion 22 of lever 18, and through platform 12, and may secure the bolt 20 on the other side of platform 12 (not shown) with a nut (not shown).

Each of levers 18 and 18' is normally lockably engaged with notches 24. Any means known to those skilled in the art for lockably engaging levers 18 and 18' with notches 24 may be used. One such means is illustrated in FIGS. 3A and 3B. In this embodiment, described below, a rod is disposed in grooves of two lever members and is thus free to move back and forth in said grooves. The ends of the rod may be located in one set of notches 24, in which case the lever members are locked into position; and, when said lever members are locked into position, the height-adjustable seat is also locked into positon. When one desires to change the position of the height-adjustable seat, the rod may be moved away from the notches 24, in which case the lever members become unlocked and can then be moved to another set of notches, locked into the new set of nothces, and thereby change the height of the seat.

Referring to FIGS. 3A and 3B, the distal end 26 of each of levers 18 and 18' is comprised of slot 28 in which rod 16 is free to move between proximal end 30 of slot 28 and distal end 32 of slot 28. Rod 16 is movably attached to lever 18 by rod 34, one of which is disposed in and secured to the distal and proxmial ends of slot 28 by conventional means; and each of the rods 28 passes through a hole in one end of rod 16, thereby allowing rod 16 to move on said rod 28 between the proximal end 30 of slot 28 and the distal end 30 of slot 28.

Rod 16 is spring-loaded in each of the slots 28 of levers 18 and 18' so that, in its normal position, rod 16 remains at or near the proximal end 30 of slot 28. As used in this specification, the term spring-loaded refers to a part that is subject to constant spring thrust or pressure. Thus, in the embodiment illustrated in FIGS. 3A and 3B, helical spring 36 insures that rod 16 remains near said proximal end, in which position it is substantially contiguous with and secured by one of notches 24 on each of its sides. Another view of spring-loaded rod 16 is presented in FIG. 1, wherein it is shown that each of the levers 18 contains a slot 28 in which rod 16 is spring-loaded and that the rod 16 so spring-loaded is contiguous with and secured by the lowest notch on platform 12.

When it is desired to adjust the height of height-adjustable bench 10, one must pull rod 16 from or near the proximal end of each of the grooves towards or near their distal ends, thereby compressing spring 36; see, e.g., FIG. 3B which shows the movement of the rod in an upward position while spring 36 has been compressed. In addition to pulling rod 16 out in order to compress each of springs 36, one must simultaneously swing levers 18 and 18' up or down until a notch is found which corresponds to the new height one desires for height-adjustable bench 10. When such new notch has been found, the compressive force on springs 36 is released, 16 is allowed to return to the proximal position of slots 28, and rod 16 then becomes contiguous with and secured by the new set of notches.

When height-adjustable seat is in the position indicated in FIG. 1, the force of the weight of someone sitting on the seat forces rod 16 up against the top of notches 24, the force of the spring forces rod 16 up against the end of notches 24, and the rod is securely captured by the notch. When height-adjustable seat is in the position indicated in FIG. 2, the force of the weight of someone sitting on the seat forces rod 16 down against the bottom of notches 16, the force of the spring forces rod 16 up against the end of notches 16, and the rod is securely captured by the notch. In all notch positions, the combination of forces securely captures the rod in the notch.

Figure 5:
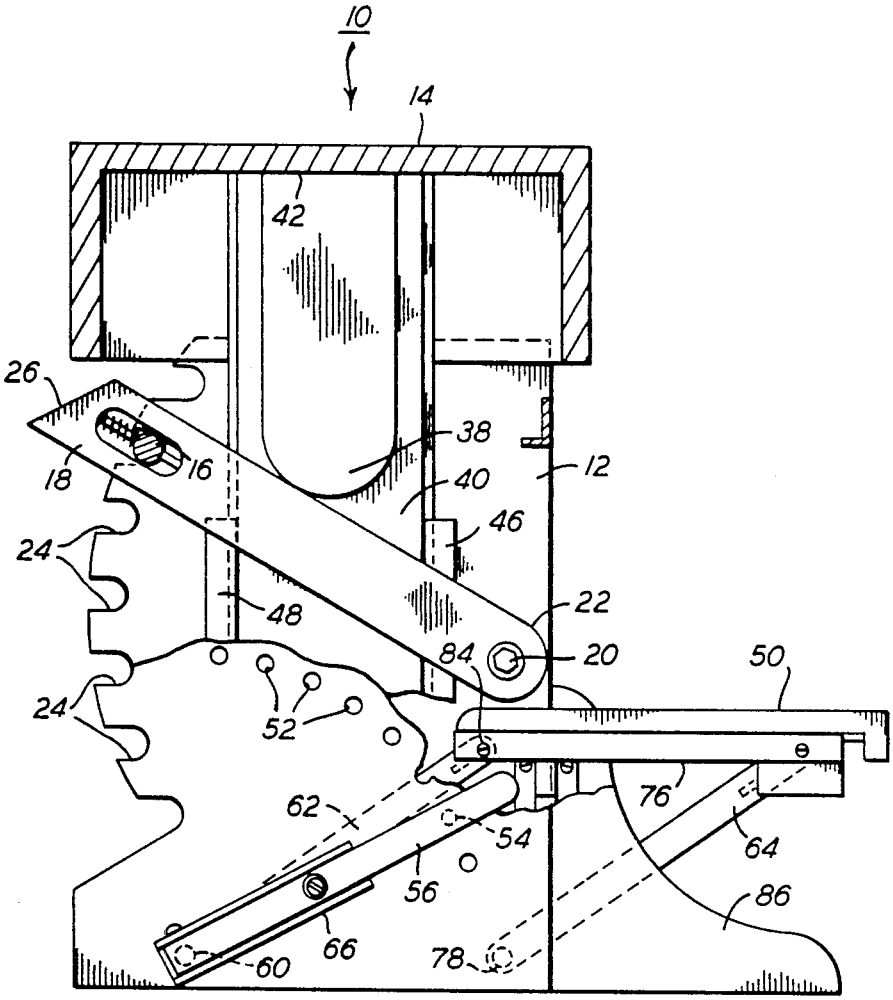
FIG. 5 is a sectional view of the bench of FIG. 1 showing the footrest in a partially down position.

The height-adjustable bench of this invention is comprised of means for adjusting the height of height-adjustable seat 14. One such means is illustrated in FIGS. 2 and 5. Referring to FIGS. 2 and 5, each of lever members 18 and 18' is contiguous with a means for raising and lowering the seat. These means can be any shape such that, when they are moved by the action of levers 18 and 18', they raise or lower seat 14 while maintaining it substantially parallel to the ground.

Referring to FIGS. 2 and 5, lever 18 is contiguous with curved block 38. Lever 18' (not shown) is also contiguous with a similarly shapecurved block (not shown). Each of the curved blocks 38 is attached to vertical sliding member, such as member 40. The end 42 of each of the curved blocks is attached to the underside of seat 14. In addition, the end 44 of each of the vertical sliding members is also attached to the underside of seat 14.

Each of the vertical sliding members, such as member 40, is captured by a track mechanism attached to the inside of platform 12. This track mechanism is defined by slats 46 and 48 which encompass sliding member 40 and limit it to substantially rectilinear motion. Thus, at all times seat 14 is maintained in a position which is substantially parallel to the floor on which bench 10 sits.

In one embodiment, not shown, at the top of each of sliding members 40 a horizontal member (not shown) is attached, forming a "T" shape. The top of this "T" supports the bottom of seat 14. When wood rod 16 is raised, the levers 18 and 18' are raised, press against the curved members 38, raise sliding member 40 within the channel formed by slats 46 and 48, and thus raise the seat.

The bench of this invention, in addition to being comprised of height-adjustable seat 14, is also comprised of height-adjustable footrest 50. Both seat 12 and footrest 50 are incrementally adjustable. Thus, as illustrated in FIG. 1, there are seven different sets of notches 26 into which rod 16 can be placed, and thus seat 14 can be placed at any one of seven different heights. There are seven different orifices 52 into which peg 54 on adjustable lever 56 can be inserted into side of platform 12, and thus footrest can be placed at any one of seven different heights. Thus, there are at least fifty-six different combinations of seat 14 height and footrest 50 height.

Figure 7A:
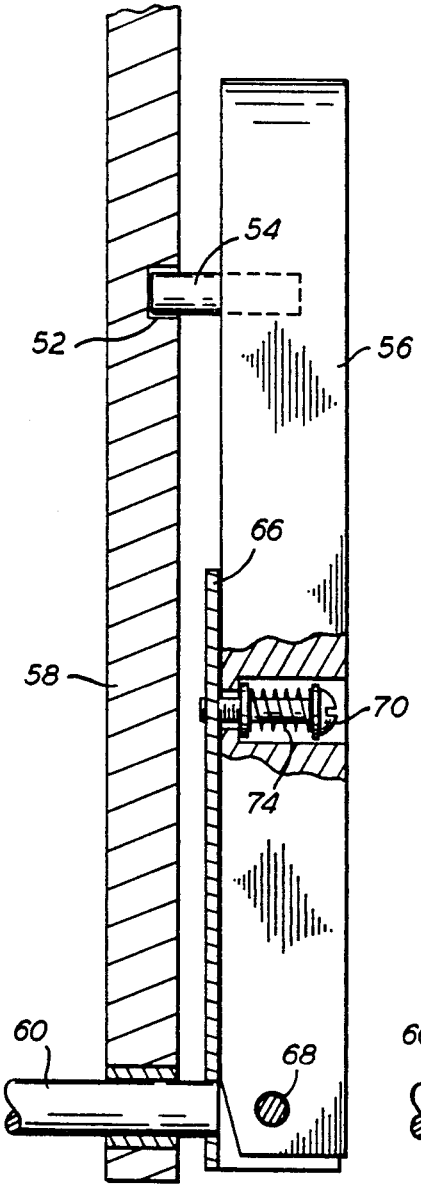
FIG. 7A is a partial view of the lever connected to said footrest when said lever is in its normally closed position.
Figure 7B:
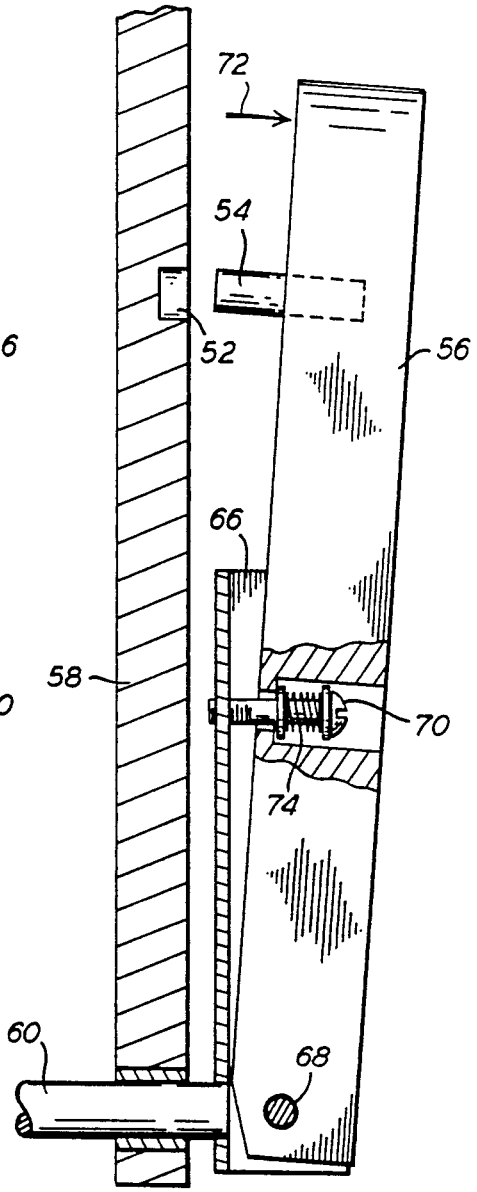
FIG. 7B is a partial view of the lever connected to said footrest when said lever is in its open position.

The bench of this invention is comprised of means for adjusting the height of said footrest 50. In the preferred embodiment illustrated in FIGS. 7A and 7B, said means is comprised of adjustable lever 56, shaft 60, linkage 62, linkage 64, shaft 78, and L-shaped supports 80.

Adjustable lever 56 is attached to U-shaped metal plate 66 which, in turn, is attached to shaft 60. Bolt 68 and a nut (not shown) attach metal plate 66 to lever 56 near the bottom portion of lever 56.

Intermediate the bottom portion of lever 56 and peg 54, adjustable lever 58 is attached to metal plate 66 by spring-loaded bolt 70. When lever 58 is pulled in the direction of arrow 72, spring 74 is compressed, peg 54 is removed from orifice 52, and lever 56 is free to be moved to another of orifices 52 into which peg 54 will be inserted by the force from spring 74.

Figure 4:
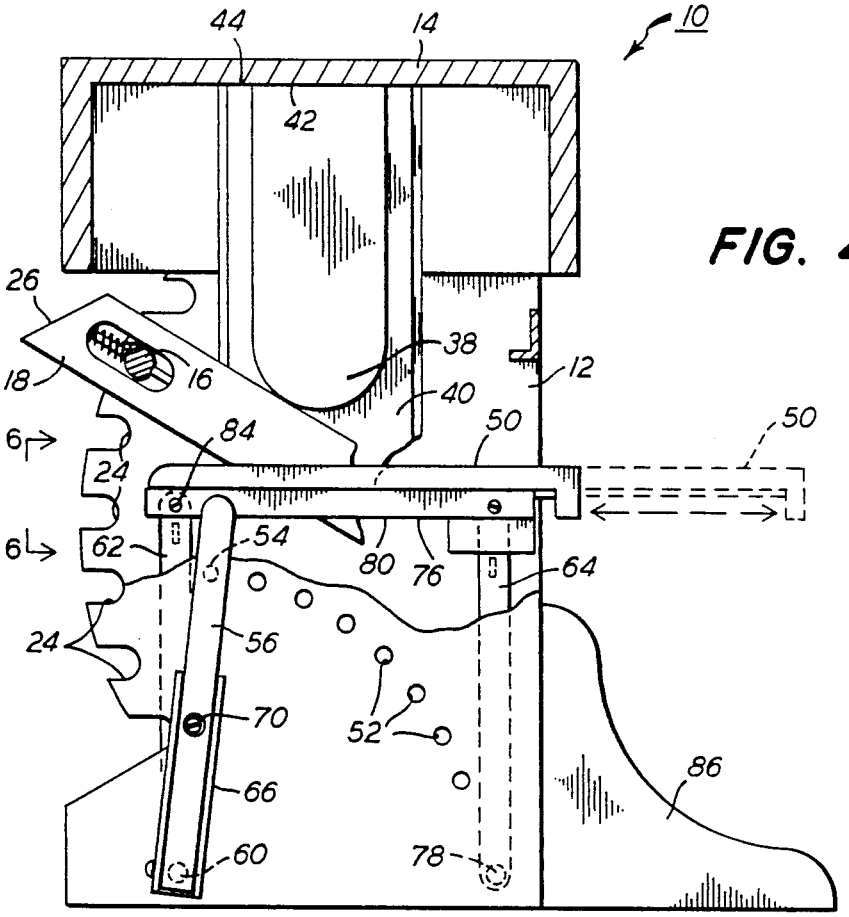
FIG. 4 is a sectional view of the bench of FIG. 1 showing how the bench's footrest slides in and out.
Figure 6:
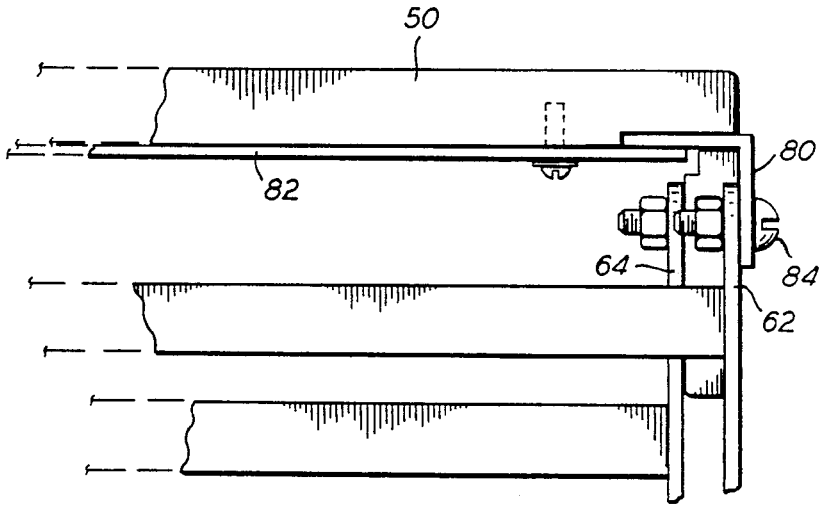
FIG. 6 is a partial back view of the bench of FIG. 1 illustrating how the footrest is slidably secured to said bench.

Shaft 60 is so connected to adjustable footrest 50 so that, when shaft 60 is rotated, the height of footrest 50 is changed. One such adjustment means is illustrated in FIGS. 4, 5, and 6.

Shaft 60 is connected to linkage 62. Linkage 62 is connected to footrest frame 76. Footrest frame 76 is comprised of parallel pieces of flat stock. Footrest frame 76 is connected to linkage 64 which, in turn, is connected to another shaft 78; shaft 60 and 78 are parallel; shaft 78 is held in place by the ends of bench 10 and, like shaft 60, can pivot. Footrest 50 is slidably attached to frame 76. Thus, when adjustable lever 56 is moved, shaft 60 rotates, causes footrest frame 76 to move, causes shaft 78 to move, and thus causes footrest 50 to change its height.

Footrest frame 76 is comprised of parallel linkages 62 and 64. There are two linkages 62, each parallel to each other, which appear on shafts 60 and 78. There are two linkages 64, each parallel to each other, which appear on shafts 60 and 78. In one preferred embodiment, each of the linkages 62 and 64 form an three-dimensional parallelogram. Linkages 62 and 64 are preferably parallel piees of flat stock.

At each end of linkages 62 and 64 are L-shaped support members which are contiguous with and support footrest 50; these L-shaped support members are attached to flat stock pieces by fastening devices which allow them to pivot, and they provide a guide so that the footrest 50 can slide towards and away from the bench 10. Thus, referring to FIG. 6, one such L-shaped support member 80 is shown attached to one end of linkage 62. The rear of support member 80 (not shown) is attached to one end of linkage 64 (not shown. Similarly, on the other side of the bench (not shown) another L-shaped support member (not shown) is also attached to the ends (not shown) of linkages 62' (not shown) and 64' (not shown).

Footrest 50 is attached to a piece of flat stock 82 near its front portion, and a similar piece of flat stock (not shown) is attached to the rear poriton of footrest 50. As is shown in FIG. 6, the end portions of flat stock 82 are contiguous with the underside of L-shaped supports, and the flat stock pieces can slide on the L-shaped supports between two limiting positions.

In one embodiment, illustrated in FIG. 6, flat stock 82 is attached to the underside of footrest 50 by screw 84. In this embodiment, footrest 50 is held against L-shaped support 80 by the end of flat stock 82 and is free to slide on L-shaped support 80. Other means for slidably mounting footrest 50 on L-shaped support 80 will be apparent to those skilled in the art.

Referring to FIGS. 1, 2, 5, and 6, bench 10 is preferably provided with two pivoting structures 86, one on each side of the bench; only one of these structures is illustrated in the Figures. Pivoting structures 86 provide anti-tipping support to the bench 10 when the footrest 50 is extended.

Structures 86 can be pivotally attached to platform 12 by means well known to those skilled in the art. Thus, as is illustrated in FIG. 2, one can use hinge 88 to pivotally attach the support structure to the platform.

Referring to FIG. 1, bench 10 is also preferably comprised of block 90 which provides floor support when footrest 50 is its lowest position.

It is to be understood that the Figures have been described with regards to one preferred embodiment described therein but that other embodiments are within the spirit and scope of the invention. Thus, in one embodiment, the height-adjustable bench of this invention is portable. Thus, for example, the height-adjustable bench of this inventioin is quick-release; the height of seat 14 and/or footrest 50 can readily be changed by the user of the bench by the use of rod 16 or lever 56. Thus, in each of its embodiments the adjustasble-height bench of this invention preferably comprises a base (such as, e.g., base 68), and to this base is connected a platform structure. In each embodiment of this bench, the height-adjustable seat is operatively connected to said platform (as, e.g., by means of levers 18 and 18', curved members 38, sliding members 40, and linkages 62 and 64). In each embodiment of this bench, there is a height-adjustable footrest 50 slidably connected to said platform (by means, e.g., of L-shaped members 80 and flat stock 82).

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

I claim:

1. A portable, quick-release, height-adjustable bench comprised of a platform, a height-adjustable seat operatively connected to said platform, means for adjusting the height of said height-adjustable seat, a height-adjustable footrest slidably engagable with said platform, means for adjusting the height of said footrest, and means for maintaining said height-adjustable seat and said height-adjustable footrest in positions such that they are always substantially parallel to each other wherein:

(a) said height adjustable seat is comprised of a curved block attached to the bottom of said height adjustable seat;

(b) said curved block is attached to a vertical sliding member;

(c) said platform comprises a multiplicity of of notches therein, a multiplicity of orifices therein, and a track attached to said platform which track is adapted to capture said vertical sliding member and to limit it and said curved block to substantially rectilinear motion;

(d) said means for adjusting the height of said height-adjustable seat comprises a lever rotatably attached to said platform, and means for releasably securing said lever within at least two of said notches, wherein said lever is contiguous with the bottom, curved portion of said curved block, whereby, when said lever is moved, both said curved block and said vertical sliding member are caused to undergo substantially rectilinear motion;

(e) said footrest is comprised of a base, a dais slidably connected to said base, a first shaft, a first parallel linkage linkage operatively connected to one end of said base and to said first shaft, a second shaft, and a second parallel linkage operatively connected to the other end of said base and to said second shaft;

(f) said means for adjusting the height of said footrest comprises an adjustable lever operatively connected to said first shaft, and means for releasably securing said adjustable lever within one of said orifices, whereby, when said adjustable lever is moved, said first shaft is caused to rotate, thereby causing the movement of said first parallel linkage, said base, said dais, and said second parallel linkage.

2. The height-adjusable bench as recited in claim 1, wherein said means for adjusting the height of said height-adjustable seat comprises at least two levers operatively connected to said seat.

3. The height-adjustable bench as recited in claim 2, wherein said means for adjusting the height of said height-adjustable seat comprises means for releasably locking said two levers into a multiplicity of different positions.

* * * * *